United States Patent [19]

Krautsack

[11] Patent Number: 4,991,335

[45] Date of Patent: Feb. 12, 1991

[54] COLLAPSIBLE TRIANGULAR MOBILE

[75] Inventor: Richard G. Krautsack, Arlington Heights, Ill.

[73] Assignee: Comark Merchandising, Inc., Elk Grove Village, Ill.

[21] Appl. No.: 331,433

[22] Filed: Mar. 31, 1989

[51] Int. Cl.[5] ..... G09F 7/22; G09F 1/08

[52] U.S. Cl. ..... 40/617; 40/539

[58] Field of Search ..... 40/539, 571, 617

[56] References Cited

U.S. PATENT DOCUMENTS

| | | | |
|---|---|---|---|
| 949,538 | 2/1910 | Ingelstroem | 40/617 |
| 1,545,771 | 7/1925 | Hout | 40/539 |
| 1,548,237 | 8/1925 | Ackermann | 40/539 |
| 1,576,672 | 3/1926 | Miller | 40/539 |
| 2,064,434 | 12/1936 | Leigh | 40/539 |
| 2,637,924 | 5/1953 | Hutt | 40/539 |
| 2,914,874 | 12/1959 | Stein | 40/617 |
| 4,392,316 | 7/1983 | Thomas | 40/539 |
| 4,825,572 | 5/1989 | Altman Robbins et al. | 40/539 |

FOREIGN PATENT DOCUMENTS

| | | | |
|---|---|---|---|
| 1231101 | 12/1966 | Fed. Rep. of Germany | 40/539 |

*Primary Examiner*—Kenneth J. Dorner
*Assistant Examiner*—James M. Gardner
*Attorney, Agent, or Firm*—Fitch, Even, Tabin & Flannery

[57] ABSTRACT

A triangular mobile has a pair of substantially identical non-creased walls connected with each other and a creased wall connected along fold-lines to the non-creased walls. A triangular plug is pivotally attached to one of the non-creased walls to be pivoted into engagement with a foldable stop carried by the other of the non-creased walls and the creased wall to support the triangular mobile in an open display position. The triangular plug includes a hanger for suspending the triangular mobile from an overhead support.

4 Claims, 2 Drawing Sheets

COLLAPSIBLE TRIANGULAR MOBILE

BACKGROUND OF THE INVENTION

The invention relates in general to mobiles and in particular to a triangular mobile which is collapsible and may be opened into a triangular self-suspending display.

One of the problems associated with product displays in retail establishments, such as grocery stores, is that they must simultaneously be eye-catching in order to attract the interest of the store patron as well as able to be compactly stored and shipped. In the past, a number of product displays have been developed, which while attractive to the consumer have not been easy to ship or easy to set up rapidly.

For instance, U.S. Pat. No. 4,392,316 to Thomas for Ceiling Suspended Product Display discloses a triangular cross-section display made up of three panels. The display requires an inordinate amount of time to set up because some of the panels, although hinged together, must be closed on each other by employing a pair of twist ties 46. In addition, the display has a tendency to be pulled in on itself due to the fact that a three-point suspension system is employed which places a sideways inward tension on the top portions of the panels. If the panels are made of relatively flexible material, such as light cardboard or paperboard, the display may have a tendency to collapse.

Another display is of the type disclosed in U.S. Pat. No. 949,538 to Igelstroem for Sign which is directed to a collapsible rectangular sign having an apex portion drawn together by a string. The sign is substantially triangular with tipped-down faces which might prevent a customer from reading the sign easily and conveniently if he were to be confronted with it at approximately eye level. In addition, the string must be carefully threaded through each of the apexes 22 of the sign.

U.S. Pat. No. 1,545,771 to Hout for Display Carton is directed to a display carton comprising a substantially planar back wall and a semicircular cylindrical wall connected to the back wall. A pair of semicircular members comprising a cover 20 and a bottom 36 are hinged away from the back wall and support the display carton in its open position. It may be appreciated that since the semicircular wall is in part not self-supporting, both the top 20 and the bottom 36 must be employed in order to render the open display carton substantially rigid.

A similar display is disclosed in U.S. Pat. No. 1,576,672 to Miller for Advertising Display Easel. Miller teaches a display having a planar back wall and a semicircular front B. A pair of ends 7 and 8, which are substantially semicircular, are hinged to the planar back wall for supporting the structure in its open position.

U.S. Pat. No. 2,064,434 to Leigh for Display Device is directed to a display system having a substantially square cross section and comprised of a single sheet of flexible material creased along fold lines. U.S. Pat. No. 2,637,924 to Hutt for Display Device discloses a display unit having a circular front wall connected to a flat back wall or in the alternative a somewhat triangularly shaped front wall as may best be seen in FIG. 5.

What is needed is a display system which may be quickly and easily set up but which may be folded compact for storage.

SUMMARY OF THE INVENTION

A triangular mobile is provided which has a pair of non-creased walls connected along a fold-line and a single creased wall, consisting of first and second creased wall portions. A compressional support member or triangular plug extends from one of the non-creased walls and is pivoted to hold the display in an open triangular cross-section configuration. A foldable stop connected to the other of the non-creased walls and one of the creased wall portions prevents the triangular plug from pivoting up and out of contact with the walls to which it is not attached. A suspension point is located at the center of mass of the triangular plug to suspend the entire unit from a flexible cord or the like. Thus, the triangular mobile provides a convenient and compact advertising medium which may be quickly and easily set up. The mobile is strong in that the triangular plug prevents collapse of the walls while being lightweight and economical.

It is a principal aspect of the present invention to provide a triangular mobile which may be compactly stored but rapidly and easily set up for display.

It is another aspect of the present invention to provide a triangular mobile which has high structural integrity with simple construction.

Other aspects and advantages of the present invention will become apparent to one skilled in the art upon a perusal of the following specification and claims in light of the accompanying drawings.

DETAILED DESCRIPTION OF THE PREFERRED EMBODIMENT

Figure 1:
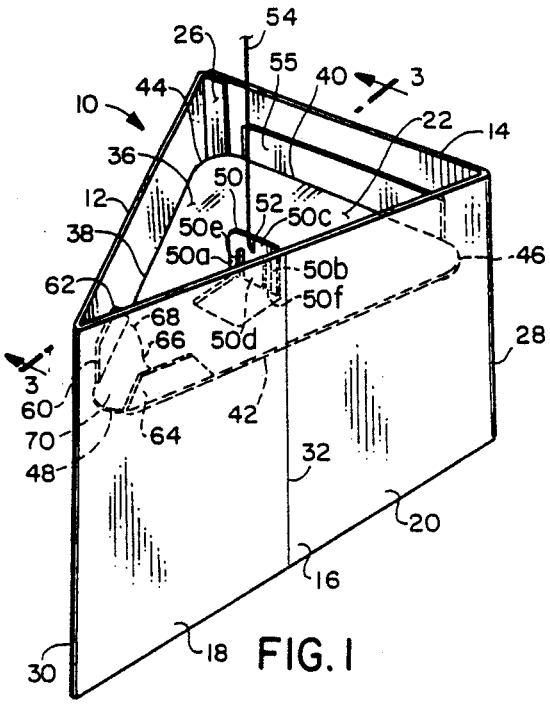
FIG. 1 is an isometric view of a triangular mobile embodying the present invention shown in its open configuration showing it suspended from an overhead point.
Figure 2:
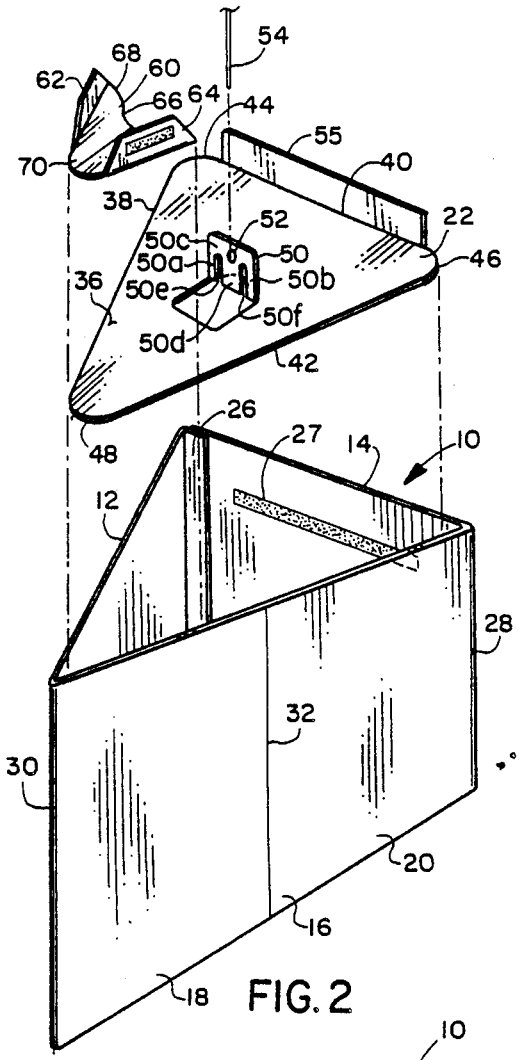
FIG. 2 is an exploded isometric view of the triangular mobile of FIG. 1.
Figure 3:
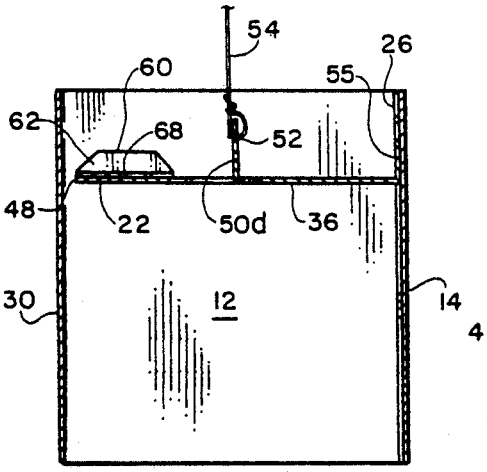
FIG. 3 is a section taken substantially along line 3—3 of FIG. 1 showing details of the internal construction of the triangular mobile.

Referring now to the drawings and especially to FIGS. 1 and 2, a triangular mobile embodying the present invention and generally referred to by numeral 10 is shown therein. The triangular mobile 10 is comprised of cardboard or paperboard and includes a first planar non-creased wall 12 and a second planar non-creased wall 14. A creased wall 16 includes a first rectangular planar portion 18 and a second rectangular planar portion 20. The walls 12, 14 and 16 are connected together. A pivoting compressional support member 22 is connected to the non-creased wall 14 for pivoting engagement with the creased wall 18 and the non-creased wall 12.

The first non-creased wall 12 is substantially rectangular and includes a margin or flange portion 26. The margin portion 26 is attached by an adhesive 27 or the like to the second non-creased wall 14 to join them together. The second non-creased wall 14 is also rectangular and has the triangular support member 22 attached to it. The rectangular wall 14 is connected to the creased wall 20 along a fold-line 28. The rectangular wall 16 is connected along a fold-line 30 to the rectangular wall 12. A crease-line 32 divides the first rectangular portion 18 from the second rectangular portion 20.

Figure 6:
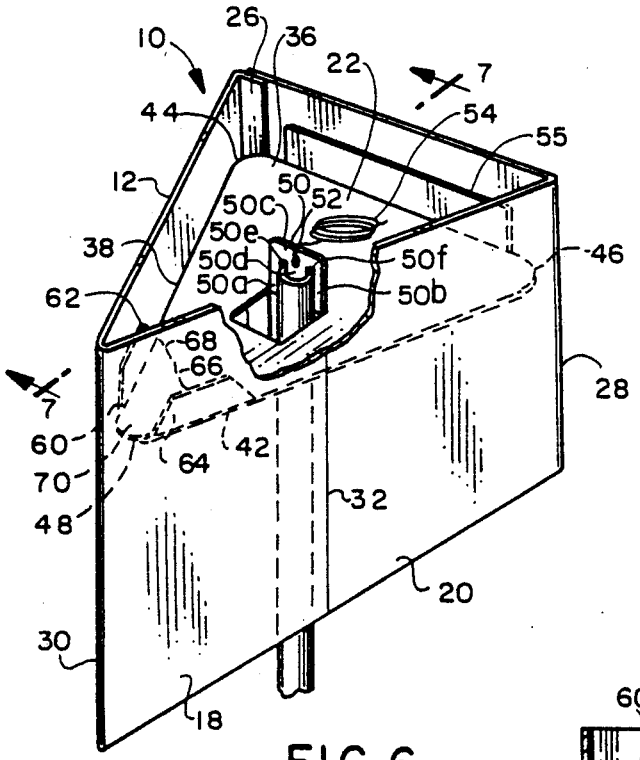
FIG. 6 is an isometric view of a triangular mobile embodying the present invention shown in its open configuration showing it supported from beneath.
Figure 7:
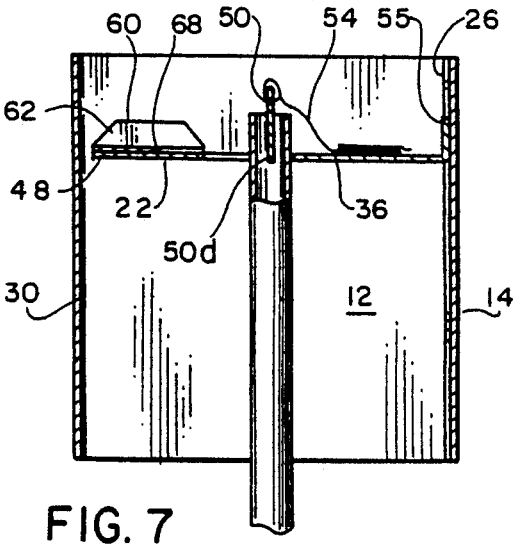
FIG. 7 is a section taken substantially along line 7—7 of FIG. 6 showing details of the internal construction of the triangular mobile.

The triangular support 22 includes a central triangular member 36 bounded by a plurality of triangular edges 38, 40 and 42. The edges 38 and 40 are joined by a rounded corner 44. The edges 40 and 42 are joined by a rounded corner 46. The edges 38 and 42 are joined by a rounded corner 48. In the center of the triangular member 36, and formed integrally therewith, are a means for suspending the triangular mobile from an overhead point and a means for supporting the triangular mobile from a point beneath the triangular mobile. The two means comprise a tab 50 formed integrally with the central triangular member 36. A pair of legs, respectively numbered **50*a* and 50*b*, comprise a portion of the tab 50 and are formed integrally with the triangular member 36. A crossbar 50*c* bridges the legs 50*a* and 50*c* and has a tongue 50*d* extending from it for engaging a supporting post. A slot 50*e* is defined by the leg 50*a*, the crossbar 50*c* and the tongue 50*d*. A slot 50*f* is defined by the leg 50*b*, the crossbar 50*c* and the tongue 50*f*. An aperture 52 is formed in the crossbar 50*c* and may have a reinforcing ring or the like mounted therein for increased strength. A support line or string 54 is threaded through the aperture 52, which may have a reinforcing ring therein, for supporting the triangular mobile 10 from an overhead support such as a ceiling. Alternatively, as may best be seen in FIGS. 6 and 7, the triangular mobile 10 may be supported by a post 54*a*, which is cylindrical and has a circularly curved wall 54*b* defining a bore 54*c*. The post 54*a* has the tongue 50*d* inserted in the bore 54*c* with the slots 50*e* and 50*f* receiving the wall 54*b* to support the triangular mobile 10 above a surface. A tab comprising an elongated rectangular section 55 is formed integral with the triangular portion 36 and defines a hinge along the line 40. The tab 55 is attached by the adhesive 27 to non-creased wall 14**.

Figure 4:
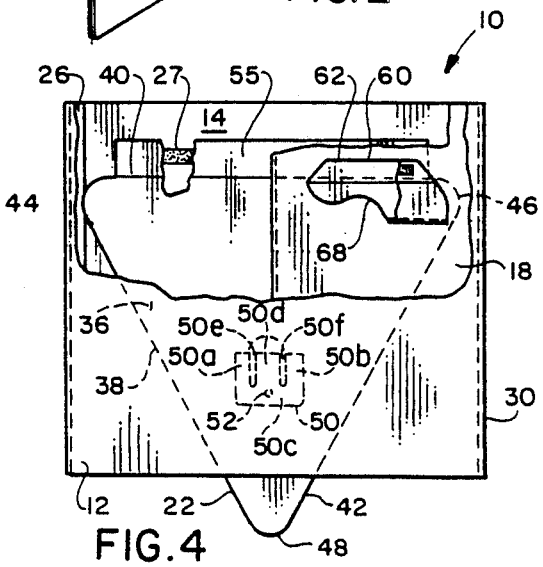
FIG. 4 is an elevational view of the triangular mobile in its collapsed form and having portions broken away and shown in phantom to show details of the organization of the internal construction in the collapsed position.
Figure 5:
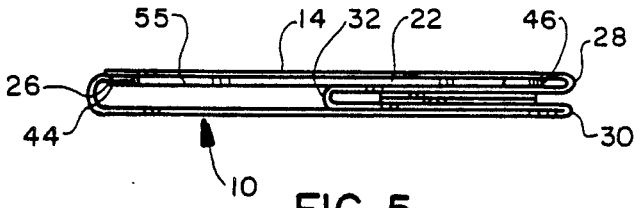
FIG. 5 is another elevational view of the triangular mobile in its collapsed form showing the manner in which the walls are stacked when the mobile is collapsed.

It may be appreciated that the compressional support member 22 may have its triangular member 36 pivoted flat against the creased wall 14 in a storage position, as may best be seen in FIGS. 4 and 5. When it is desired to open the triangular mobile 10, the fold lines 28 and 30 are pulled apart causing the display to open into a triangular cross-section, at which point the triangular support 36 is pivoted up into engagement with an automatically out-folding positive stop 60. The automatically out-folding positive stop 60 bridges the rectangular wall portion 18 and the non-creased wall 12. The automatically out-folding positive stop 60 includes a first wing 62 and a second wing 64. The first wing 62 is adhesively attached to the non-creased wall 12. The second wing 64 is adhesively attached to the first wall portion 18. A folding stop section 66 comprising a first half 68 and a second half 70 is attached to the wings 62 and 64. When the non-creased wall 12 and the first wall portion 18 are separated from each other, the automatically out-folding positive stop 60 is pulled into its open position with the folding stop section 66 and its first and second halves 68 and 70 held substantially coplanar with the triangular support member 36 when the triangular support member 36 is pivoted into engagement with the stop halves 68 and 70. Thus, when the triangular mobile 10 is fully opened and suspended by its cord 54, the triangular support member 36 is urged firmly into engagement with the automatically out-folding positive stop 60 and holds the triangular mobile 10 open.

It may be appreciated that various information and display indicia may be appear on the outside portions of the walls 12, 14 and 16 for viewing by the public. It may also be appreciated that the instant invention provides a triangular mobile which is quite compact when it is collapsed and which opens into a self-supporting structure for displaying information. The device may be rapidly and easily set up within a few seconds.

While there has been illustrated and described a particular embodiment of the present invention, it will be appreciated that numerous changes and modifications, will occur to those skilled in the art, and it is intended in the appended claims to cover all those changes and modification which fall within the true spirit and scope of the present invention.

What is claimed is:

1. A triangular mobile, comprising a first non-creased wall;

second non-creased wall connected to said first non-creased wall;

a creased wall having a first wall portion connected to said first non-creased wall and a second wall portion connected to said second non-creased wall;

a compressional support member connected to said first non-creased wall for pivoting into engagement with said second non-creased wall and said creased wall to hold said triangular mobile in an open stable configuration, said compressional support having a tab comprising a pair of legs, a crossbar briding said legs and defining an aperture for accommodating a first support, and a tongue extending from said crossbar for engaging a second support; and an automatically out-folding positive stop connected to said second non-creased wall and said creased wall to be engaged by said compressional support member when it engages said second non-creased wall and said creased wall.

2. A triangular mobile as deinfed in claim 1, wherein said first non-creased wall is rectangular and said second non-creased wall is rectangular.

3. A triangular mobile as defined in claim 1, wherein said compressional support member comprises a triangular compressional support member.

4. A triangular mobile as defined in claim 3, wherein said triangular compressional support member comprises a first portion which is attached to said first non-creased wall and a second portion which is pivotable with respect to said first portion.

* * * * *